US011487219B2

(12) United States Patent
Iwata et al.

(10) Patent No.: US 11,487,219 B2
(45) Date of Patent: Nov. 1, 2022

(54) IMAGING SYSTEM WITH CONTROL MEMBER FOR CONVEYANCE PATH AND DEVELOPING ROLLER HAVING A PEELING POLE

(71) Applicant: Hewlett-Packard Development Company, L.P., Spring, TX (US)

(72) Inventors: Naoya Iwata, Yokohama (JP); Takayuki Yamada, Yokohama (JP); Yuya Kato, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/414,810

(22) PCT Filed: Aug. 25, 2020

(86) PCT No.: PCT/US2020/047759
§ 371 (c)(1),
(2) Date: Jun. 16, 2021

(87) PCT Pub. No.: WO2021/050259
PCT Pub. Date: Mar. 18, 2021

(65) Prior Publication Data

US 2022/0197181 A1 Jun. 23, 2022

(30) Foreign Application Priority Data

Sep. 10, 2019 (JP) ..... JP2019-164798

(51) Int. Cl.
*G03G 15/08* (2006.01)
*G03G 15/09* (2006.01)
*G03G 21/20* (2006.01)

(52) U.S. Cl.
CPC ..... *G03G 15/0808* (2013.01); *G03G 15/0813* (2013.01); *G03G 15/09* (2013.01);
(Continued)

(58) Field of Classification Search
CPC ..... G03G 15/0808; G03G 15/0813; G03G 15/09; G03G 15/0805; G03G 15/0921;
(Continued)

(56) References Cited

U.S. PATENT DOCUMENTS 5,953,563 A 9/1999 Yamaguchi et al.
6,009,295 A 12/1999 Kimura et al.
(Continued)

FOREIGN PATENT DOCUMENTS

JP 2009205129 A 9/2009
KR 19980014785 6/1998

*Primary Examiner* — Walter L Lindsay, Jr.
*Assistant Examiner* — Laura Roth
(74) *Attorney, Agent, or Firm* — Jefferson IP Law, LLP

(57) ABSTRACT

An imaging system includes: a housing including a developing chamber, a developing roller located in the developing chamber to transport a developer and spaced apart from the housing; a conveyance path extending along at least part of a periphery of the developing roller in order to form a flow of air including the developer; and a control member. The developing roller includes a peeling pole at a fixed position with respect to the housing, to discharge the developer. The control member is located along the conveyance path in proximity to the peeling pole of the developing roller, to reduce a flow rate of the air flowing through the conveyance path.

9 Claims, 17 Drawing Sheets

(52) U.S. Cl.
CPC ..... *G03G 15/0921* (2013.01); *G03G 15/0942* (2013.01); *G03G 21/206* (2013.01)

(58) Field of Classification Search
CPC ..... G03G 15/0942; G03G 2215/0609; G03G 2221/1645; G03G 21/206
See application file for complete search history.

(56) References Cited

U.S. PATENT DOCUMENTS

| | | | | |
|---|---|---|---|---|
| 7,398,027 | B2 | 7/2008 | Koshida et al. | |
| 7,509,066 | B2 | 3/2009 | Koshida | |
| 10,877,400 | B1 * | 12/2020 | Kuramoto | G03G 21/206 |
| 2001/0010767 | A1 | 8/2001 | Watanabe | |
| 2011/0229184 | A1 * | 9/2011 | Kashimoto | G03G 15/0896 399/92 |
| 2012/0039637 | A1 * | 2/2012 | Ochi | G03G 15/0921 399/272 |
| 2014/0348545 | A1 | 11/2014 | Shiba et al. | |
| 2015/0010323 | A1 | 1/2015 | Okuma et al. | |
| 2018/0267427 | A1 * | 9/2018 | Kuramoto | G03G 15/0822 |
| 2020/0301313 | A1 * | 9/2020 | Suganuma | G03G 15/0898 |
| 2021/0278783 | A1 * | 9/2021 | Kato | G03G 15/104 |
| 2021/0373456 | A1 * | 12/2021 | Iwata | G03G 15/0896 |

* cited by examiner

IMAGING SYSTEM WITH CONTROL MEMBER FOR CONVEYANCE PATH AND DEVELOPING ROLLER HAVING A PEELING POLE

BACKGROUND

A developing device includes a flow path forming member that extends longitudinally in a rotational direction of a development sleeve of a toner movement mechanism, between the development sleeve and an inner wall of a developing device main body. An inflow port of an inflow path portion formed between the flow path forming member and the development sleeve, and an ejection port of an ejection flow path portion formed between the flow path forming member and the inner wall of the developing device main body are disposed to be adjacent to each other. Accordingly, an increase in an atmospheric pressure in the developing device main body is suppressed, and thus, the scattering of a toner to the outside of the developing device main body is suppressed.

DETAILED DESCRIPTION

Figure 1:
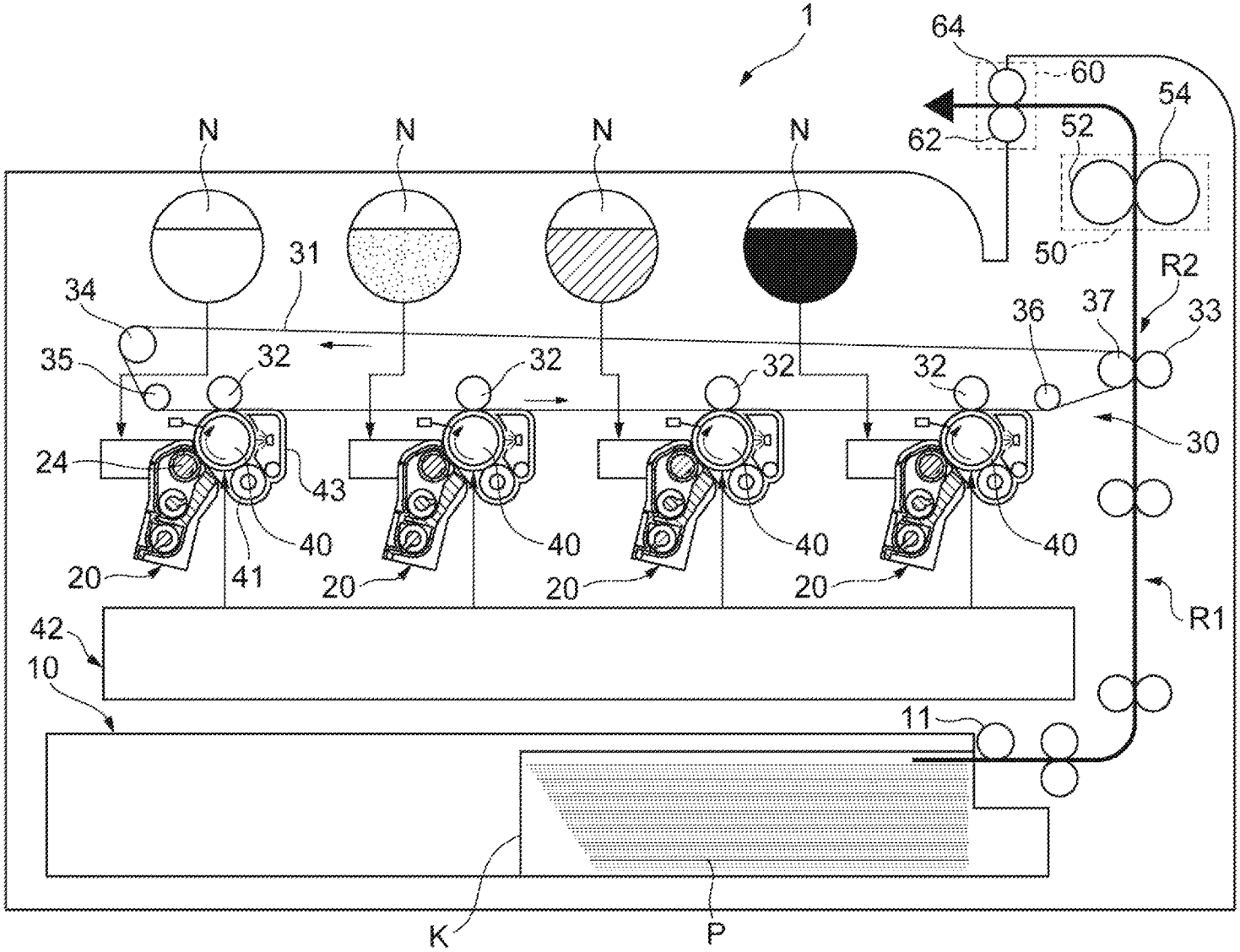
FIG. 1 is a schematic diagram of an example image forming apparatus.

Hereinafter, an example image forming system or imaging system will be described with reference to the drawings. The image forming system (or imaging system) may be an image forming apparatus such as a printer, or may be a fixing device that is used in the image forming apparatus, or the like. Furthermore, in the description based on the drawings, the same reference numerals will be applied to the same constituents or constituents having the same functions, and the overlapping description is omitted.

With reference to FIG. 1, a schematic configuration of an example of an image forming apparatus will be described. An image forming apparatus 1 illustrated in FIG. 1 is a device that forms a color image by using the colors of magenta, yellow, cyan, and black. The image forming apparatus 1 includes a conveying device 10 that conveys paper P which is a recording medium, a developing device 20 that develops a static latent image, a transfer device 30 that secondarily transfers a toner image to the paper P, an image carrying body 40 including a surface (a circumferential surface) on which the static latent image is formed, a fixing device 50 that fixes the toner image onto the paper P, and an ejection device 60 that ejects the paper P.

The conveying device 10 conveys the paper P as the recording medium on which an image is to be formed, along a conveyance route R1. The paper P is stacked and contained in a cassette K, and is conveyed by being picked up with a paper feeding roller 11. The conveying device 10 directs the paper P to reach a transfer nip portion R2 through the conveyance route R1 at a timing when the toner image to be transferred to the paper P, reaches the transfer nip portion R2.

Four developing devices 20 are provided, one for each color. Each of the developing devices 20 includes a developing roller 24 that transfers the toner onto the image carrying body 40. In the developing device 20, a two-component developer containing a toner and a carrier is used as a developer. In some examples, in the developing device 20, a mixing ratio of the toner and the carrier may be adjusted to a targeted mixing ratio, and the toner may be homogeneously dispersed by being mixed and stirred, to achieve a developer with an optimal charge amount. Such a developer may be carried on the developing roller 24. When the developer is carried to a region facing the image carrying body 40, with the rotation of the developing roller 24, the toner in the developer that is carried on the developing roller 24 is moved to the static latent image that is formed on the circumferential surface of the image carrying body 40, and the static latent image is developed.

The transfer device 30 conveys the toner image that is formed by the developing device 20 to the transfer nip portion R2 where the toner image is secondarily transferred to the paper P. The transfer device 30 includes a transfer belt 31 to which the toner image is primarily transferred from the image carrying body 40, suspension rollers 34, 35, 36, and 37 suspending the transfer belt 31, a primary transfer roller 32 that is positioned to interpose the transfer belt 31 together with the image carrying body 40, and a secondary transfer roller 33 that is positioned to interpose the transfer belt 31 together with the suspension roller 37.

The transfer belt 31 is an endless belt that is rotated and driven by the suspension rollers 34, 35, 36, and 37. The suspension rollers 34, 35, 36, and 37 are rotatable around respective axis lines. The suspension roller 37 is a driving roller that is rotationally driven around the axis line, and the suspension rollers 34, 35, and 36 are driven rollers that are driven to be rotated in accordance with the rotational driving of the suspension roller 37. The primary transfer roller 32 is provided to press against the image carrying body 40 from an inner circumference side of the transfer belt 31. The secondary transfer roller 33 is disposed in parallel with the suspension roller 37 and positioned to interpose the transfer belt 31 between the secondary transfer roller 33 and the suspension roller 37. The secondary transfer roller 33 presses against the suspension roller 37 from an outer circumference side of the transfer belt 31. Accordingly, the transfer nip portion R2 is formed between the secondary transfer roller 33 and the transfer belt 31.

The image carrying body 40 may also be referred to as a static latent image carrying body, a photoreceptor drum, and the like. Four image carrying bodies 40 are provided, one for each color. The image carrying bodies 40 are spaced apart along a movement direction of the transfer belt 31. The developing device 20, a charging roller 41, an exposure unit (or exposure device) 42, and a cleaning unit (or cleaning device) 43 are provided around the circumference of the image carrying body 40.

The charging roller 41 is a charging means that homogeneously (or uniformly) charges the surface of the image carrying body 40 to a predetermined potential. The charging roller 41 is moved by following the rotation of the image carrying body 40. The exposure unit 42 exposes the surface of the image carrying body 40 that has been charged by the charging roller 41, in accordance with the image to be formed on the paper P. Accordingly, the potential of a portion that is exposed by the exposure unit 42 on the surface of the image carrying body 40 is changed, and thus, the static latent image is formed. Four developing devices 20 respectively develop static latent images formed on the respective image carrying bodies 40 by the toner that is supplied from the respective toner tanks N provided to face each of the developing devices 20, in order to generate the toner image. The toner tanks N contain toner of magenta, yellow, cyan, and black, respectively, and a carrier having a constant ratio with respect to a toner weight. The cleaning unit 43 collects the toner that remains on the image carrying body 40 after the toner image formed on the image carrying body 40 has been primarily transferred to the transfer belt 31.

The fixing device 50 allows the paper P to pass through a fixing nip portion where the toner image that has been secondarily transferred to the paper P is attached and fixed to the paper P, with heat and pressure. The fixing device 50 includes a heating roller 52 that heats the paper P, and a pressure roller 54 that presses against the heating roller 52 to be rotationally driven. The heating roller 52 and the pressure roller 54 are substantially cylindrical in shape, and a heat source such as a halogen lamp is provided in the heating roller 52. The fixing nip portion that is a contact region is provided between the heating roller 52 and the pressure roller 54, and when the paper P passes through the fixing nip portion, the toner image is melted to be fixed to the paper P.

The ejection device 60 includes ejection rollers 62 and 64 for ejecting the paper P to which the toner image has been fixed to the outside of the device.

An example printing operation of the image forming apparatus 1 will be described. When an image signal of a recorded image is input to the image forming apparatus 1, a controller of the image forming apparatus 1 rotates the paper feeding roller 11, and conveys the paper P stacked in the cassette K by picking up the paper P. Then, the surface of the image carrying body 40 is homogeneously charged to a predetermined potential by the charging roller 41, on the basis of the received image signal (a charging operation). After that, the surface of the image carrying body 40 is irradiated with laser light by the exposure unit 42, and thus, the static latent image is formed (an exposure operation).

In the developing device 20, the static latent image is developed, and the toner image is formed (a developing operation). The toner image that is formed as described above is primarily transferred to the transfer belt 31 from the image carrying body 40, in a region in which the image carrying body 40 faces the transfer belt 31 (a transfer operation). The toner images formed respectively on four image carrying bodies 40 are sequentially layered on the transfer belt 31, and thus, a single composite toner image is formed. The composite toner image is secondarily transferred to the paper P that is conveyed from the conveying device 10, in the transfer nip portion R2 in which the suspension roller 37 faces the secondary transfer roller 33.

The paper P to which the composite toner image is secondarily transferred is conveyed to the fixing device 50. When the paper P passes through the fixing nip portion, the paper P is heated and pressed by the fixing device 50 between the heating roller 52 and the pressure roller 54, and thus, the composite toner image is melted to be fixed to the paper P (a fixing operation). The paper P is ejected to the outside of the image forming apparatus 1 by the ejection rollers 62 and 64.

Figure 2:
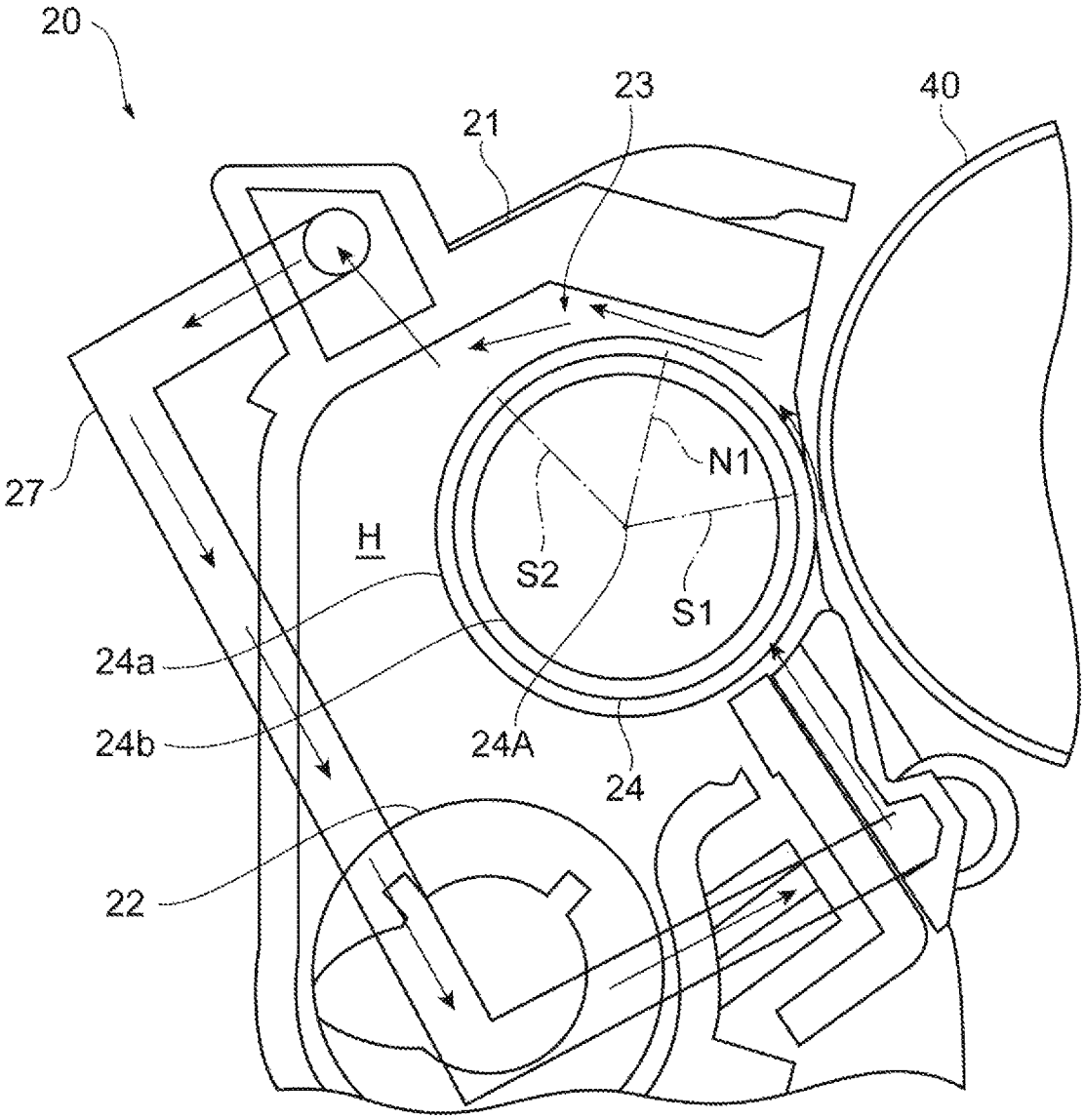
FIG. 2 is a schematic diagram illustrating a cross-section of an example developing device.

FIG. 2 is a schematic cross-sectional view of an example developing device 20. The example developing device 20 includes the image carrying body 40 that is rotatable, a container (a housing) 21, a stirring conveying member 22, the developing roller 24 that is disposed at an interval (or distance) from the container (housing) 21, and a bypass flow path 27. The developing device may further include a control member, such as a cover member 25 (cf. FIG. 4), as will be described further below. The cover member 25 may also be referred to herein as an add-on device, a protrusion device, an airflow regulator, an auxiliary device, or the like, according to examples.

A static latent image is formed on the surface of the image carrying body 40. The image carrying body 40 may be rotatably supported with respect to the housing (container) 21, to be rotationally driven by a driving source such as a motor. The image carrying body 40 may have a substantially columnar or cylindrical shape.

The housing 21 contains the developer that includes the toner and the carrier. That is, the housing 21 includes a developer containing chamber H (a developing chamber) to contain the developer that includes the toner and the carrier. The housing 21 contains the stirring conveying member 22 and the developing roller 24. The housing 21 has an opening at a position where the developing roller 24 faces the image carrying body 40, and the toner in the developer containing chamber H is supplied to the image carrying body 40 through the opening. Air is taken in (or drawn into) the housing 21 as the developing roller 24 is rotated. The taken-in air (or drawn air) flows through the bypass flow path 27 described below, through the conveyance route (or conveyance path) 23, and to form circulated air represented by arrows in FIG. 2. The conveyance route 23 is a space extending along a portion of the periphery of the developing roller 24 in order to provide a circulated air flow including the developer. Specifically, the conveyance route 23 is formed in a space between the housing 21 and the developing roller 24, and may be adjacent a conveyance pole N1 and a peeling pole S of the developing roller 24, e.g., at a location of the space that faces or aligns with the conveyance pole N1 and the peeling pole S2 (described below). The housing 21 includes a developer ejection port to eject the developer that has aged, from the developer containing chamber H. In the developing device 20, for example, the developer achieving a height equal to or greater than a certain height is overflowed, and is ejected from the developer ejection port, in accordance with an auto developer refill (ADR) technology.

In the developer containing chamber H, the stirring conveying member 22 stirs a magnetic carrier and a non-magnetic toner that form the developer, to perform friction charge to the carrier and the toner. The stirring conveying member 22 conveys the developer while stirring the developer in the developer containing chamber H. Although FIG. 2 shows a portion of the developing device 20 including one stirring conveying member 22, the developing device 20 further includes another stirring conveying member 22.

The developing roller 24 is disposed to face the image carrying body 40 such that a gap is formed between the developing roller 24 and the image carrying body 40. The developing roller 24 is rotated to carry the developer contained in the housing 21 on the surface of the developing roller 24. The developing roller 24 may have a substantially columnar or cylindrical shape or the like. The developing roller 24 is disposed longitudinally in the developer containing chamber H such that an axis line (or rotational axis) 24A of the developing roller 24 is parallel to an axis line (or rotational axis) of the image carrying body 40, and a distance between the developing roller 24 and the image carrying body 40 is constant in a direction of the axis line 24A (in a longitudinal direction). The developing roller 24 carries the developer that is stirred by the stirring conveying member 22 on the surface of the developing roller 24. The developing roller 24 conveys (transports) the developer that is carried to a developing region, and thus, develops the static latent image of the image carrying body 40. The developing region is a region in which the developing roller 24 faces the image carrying body 40. The developing region may be a nip region in which the developing roller 24 is closest to the image carrying body 40.

The developing roller 24 includes a development sleeve 24*a* forming a surface layer of the developing roller 24, and a magnet 24*b* disposed in the development sleeve 24*a*. The development sleeve 24*a* is a cylindrical member formed of a non-magnetic metal. The development sleeve 24*a* is rotatable around the axis line 24A. The development sleeve 24*a* may be rotatably supported on the magnet 24*b*, and may be rotationally driven by a driving source such as a motor. The developer is carried on the surface of the development sleeve 24*a* by a magnetic force of the magnet 24*b*. The developing roller 24 conveys the developer in a rotational direction of the development sleeve 24*a*, in accordance with the rotation of the development sleeve 24*a*.

The magnet 24*b* is fixed to the housing 21, and includes a plurality of magnetic poles. For example, a magnetic pole may extend along an axis direction (e.g., the direction of the rotational axis 24A of the developing roller 24) in the magnet 24*b*, at an angle position that may be set in advance. As the development sleeve 24*a* rotates, when the developer passes through a location adjacent each of the magnetic poles of the magnet 24*b* (at a fixed position with respect to the housing 21), a magnetic force acts on the developer on the development sleeve 24*a*. As illustrated in FIG. 2, the magnet 24*b* includes a plurality of magnetic poles including a main pole S1, the conveyance pole N1, and the peeling pole (a developer release pole) S2. The magnet 24*b* may further include another peeling pole (developer release pole) that is an S pole, and a layer regulating pole that is an N pole. The main pole S1 is an S pole, and is a magnetic pole for forming a magnetic brush (cf. FIG. 3) that extends toward the image carrying body 40 in order to supply the developer to the image carrying body 40. The conveyance pole N1 is an N pole, and is a magnetic pole for conveying the magnetic brush of which the supply of the developer is ended into the housing 21. The peeling pole S2 is an S pole, and is a magnetic pole for peeling the magnetic brush that is conveyed into the housing 21 from the surface of the development sleeve 24*a* to be returned to a stirring region in which stirring is performed by the stirring conveying member 22. For example, the peeling pole S2 is a magnetic pole where the developer is discharged so as to be released from the developing roller 24. Furthermore, the magneticities described above (e.g., magnetic poles, S pole and N pole) may be reversed.

The magnetic brush of the developer (napping) is formed on the development sleeve 24*a* by the magnetic forces the magnetic poles of the magnet 24*b*. The developing roller 24 allows the napping of the developer that is formed by the magnetic pole to be in contact with or to approach (to become close to) the static latent image of the image carrying body 40, in the developing region. Accordingly, the toner in the developer that is carried on the developing roller 24 is moved to the static latent image that is formed on the circumferential surface of the image carrying body 40, and thus, the static latent image is developed.

The bypass flow path 27 is a flow path formed to take in the air that flows in the conveyance route (or conveyance path) 23 and to eject the air to an upstream side of the developing region (the nip region) of the developing roller 24. The bypass flow path 27 takes in the air that flows in the housing 21 in accordance with the rotation of the developing roller 24 through the conveyance route 23, circulates the air in the direction of the arrow illustrated in FIG. 2, and ejects the air to the upstream side of the developing region of the developing roller 24. For example, in a case where the bypass flow path 27 is not provided, a positive pressure is generated in a region on the conveyance route 23 side in which the air flows, whereas a negative pressure is generated on the upstream side of the developing region of the developing roller 24, in accordance with the rotation of the developing roller 24. In such a state, an increase in an internal pressure of the developing device 20 and the outflow of the air from a location having weak airtightness may cause toner to scatter or the like, as will be described further below. From such a viewpoint, the air that flows from the conveyance route 23 is ejected to the upstream side of the developing region of the developing roller 24 via the bypass flow path 27, to suppress a decrease of a pressure on a downstream side of the conveyance route 23 and an increase of a pressure in the developing device 20. In addition, the bypass flow path 27 may generate a circulated air flow in which the air flowing in accordance with the rotation of the developing roller 24 is returned to the developing region of the developing roller 24 via the conveyance route 23 and the bypass flow path 27, and flows again in the conveyance route 23. Then, the toner (a floating toner) transported in the circulated air is collected by the magnetic brush that is formed on the surface of the development sleeve 24*a* of the developing roller 24.

Figure 3:
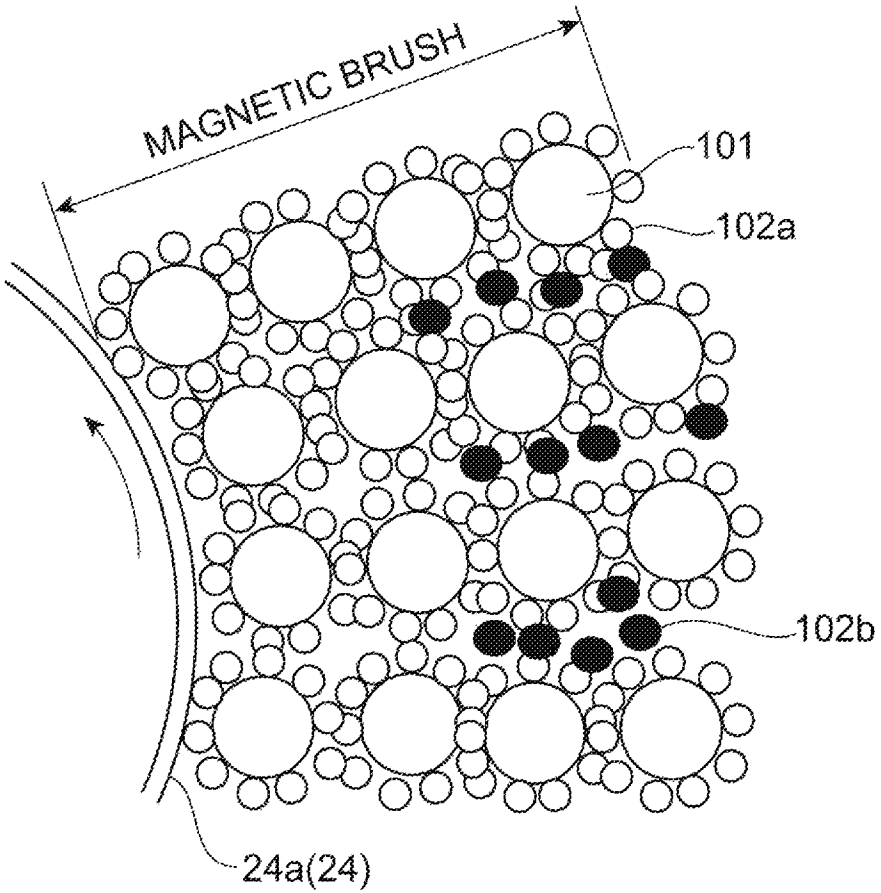
FIG. 3 is a diagram illustrating the collecting of a toner in circulated air by a magnetic brush.

FIG. 3 is a diagram illustrating the collection of the toner in the circulated air with the magnetic brush. FIG. 3 illustrates the surface of the development sleeve 24*a* of the developing roller 24. As illustrated in FIG. 3, the magnetic brush includes a carrier 101 that is magnetically retained on the developing roller 24, and a toner 102*a* that is electrostatically retained around the carrier 101. A toner 102*b* (a floating toner) in the circulated air is collected by the magnetic brush.

Figure 4:
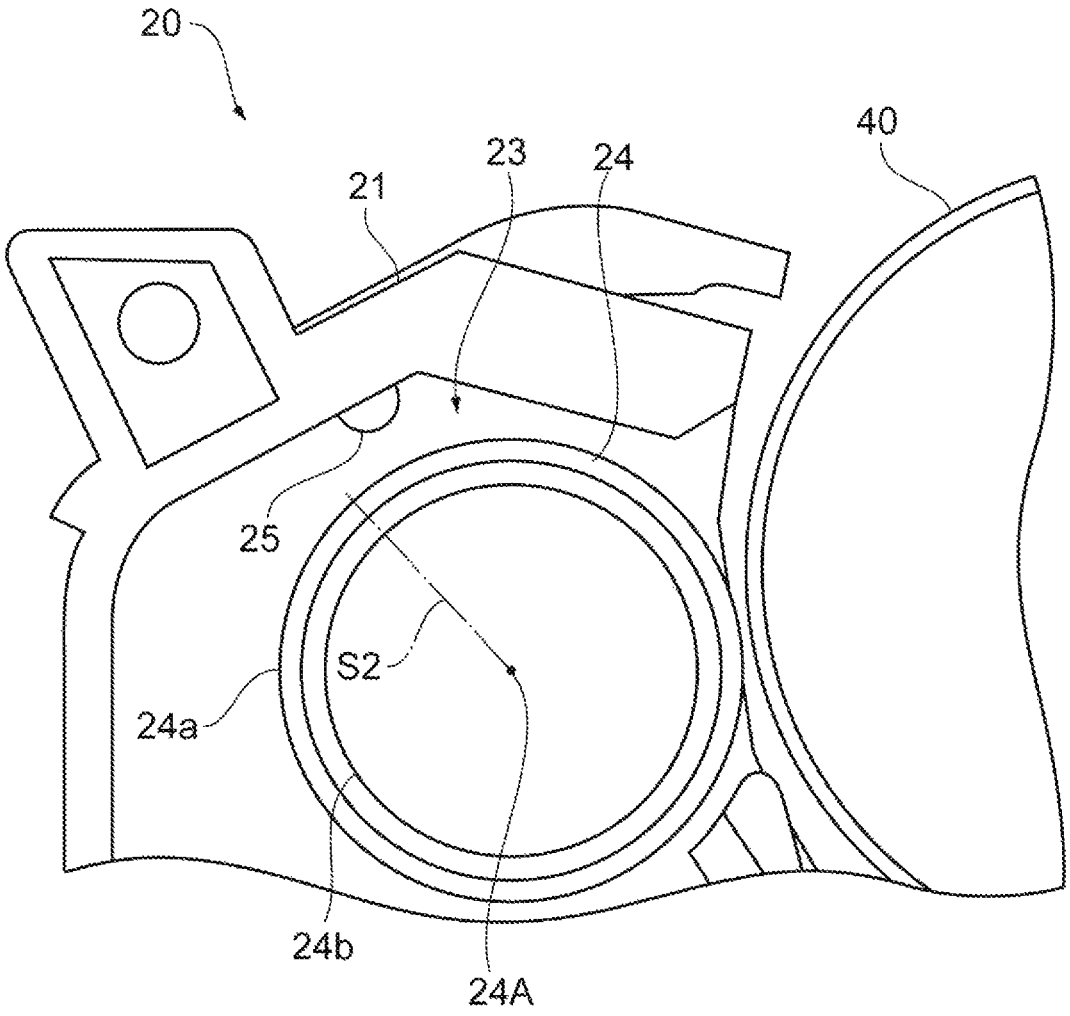
FIG. 4 is a schematic diagram illustrating a portion of a developing device including an example control member.

FIG. 4 is a schematic view of an example developing device 20 having an example control member. As illustrated in FIG. 4, the developing device 20 further includes the cover member 25 as a control member that reduces an air flow rate flowing through the conveyance route (or conveyance path) 23. The cover member 25 is disposed on the conveyance route 23 to be in proximity to the peeling pole S2 of the developing roller 24. The vicinity of the peeling pole S2 is configured such that a layer thickness of the developer may be relatively thick and a gap between the housing 21 and the developing roller 24 is relatively wide to accommodate the effect of a repulsive magnetic field or the like. The cover member 25 is attached to the housing 21, and is positioned longitudinally along the direction of the axis line 24A of the developing roller 24 to extend toward the developing roller 24. The cover member 25 is disposed on the conveyance route 23 such that a spaced distance from the developing roller 24 (for example, a gap between the surface of the development sleeve 24*a* and a tip end of the cover member 25) is constant. The cover member 25 is provided to suppress a rate of an air flow taken into the developing device 20 due to a decrease in an air inflow space of the conveyance route 23.

Figure 5:
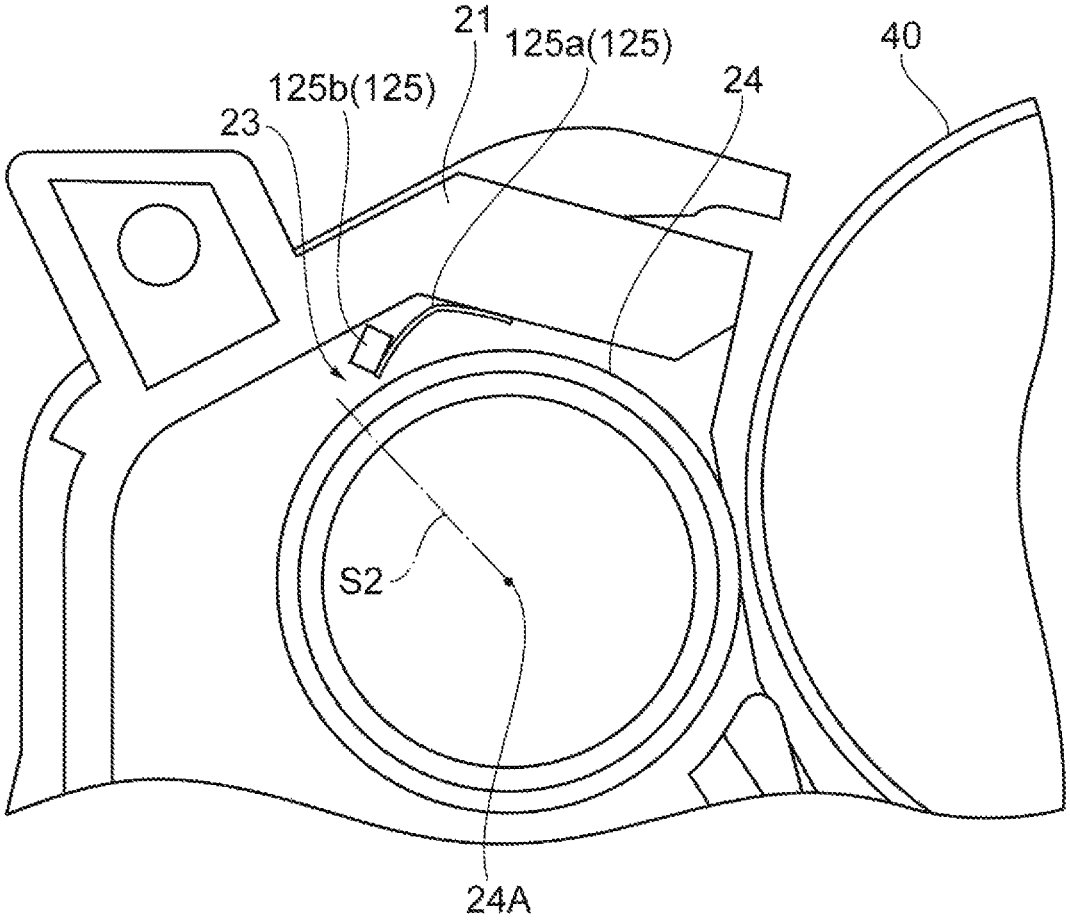
FIG. 5 is a schematic diagram illustrating a portion of a developing device including an example control member.

FIG. 5 is a schematic view of an example control member. As illustrated in FIG. 5, the developing device 20 may include the control member 125 instead of (or in addition to) the cover member 25, as a control member that reduces the rate of air flow flowing through the conveyance route (or conveyance path) 23. The control member 125 is disposed on the conveyance route 23 to be in proximity to the peeling pole S2 of the developing roller 24. The control member 125 includes an elastic sheet member 125*a* and a weight member 125*b*. The elastic sheet member 125*a* may include a sheet-like member having elasticity such as a urethane film, and may extend along the longitudinal direction (the direction of the axis line 24A) of the developing roller 24. One end (e.g., a first edge or first longitudinal edge) of the elastic sheet member 125*a* is attached to the housing 21. The weight member 125*b* may include a synthetic resin (a modified resin) such as an ABS resin, and may extend along the direction of the axis line 24A of the developing roller 24. The weight member 125*b* is attached to the other end of the elastic sheet member 125*a* e.g., a second edge (or second longitudinal edge or an end portion) opposite the first edge that is not attached to the housing 21.

In the control member 125, the second longitudinal edge of the elastic sheet member 125*a* is pressed against the surface of the development sleeve 24*a* of the developing roller 24 by the weight of the weight member 125*b* (e.g., via gravitational force). The control member 125 applies a constant load (a constant pressure) according to the weight of the weight member 125*b* onto the surface of the development sleeve 24*a* of the developing roller 24. In such a constant load type control member, for example, even in a case where a conveyance amount of the developer per unit area in the developing roller 24 (the thickness of the developer on the surface of the development sleeve 24*a*) is changed, a constant pressure is applied to the surface of the development sleeve 24*a*, and thus, it is possible to control the air flow rate to be constant. Hereinafter, another example of the constant load type control member will be described with reference to FIG. 6 to FIG. 9.

Figure 6:
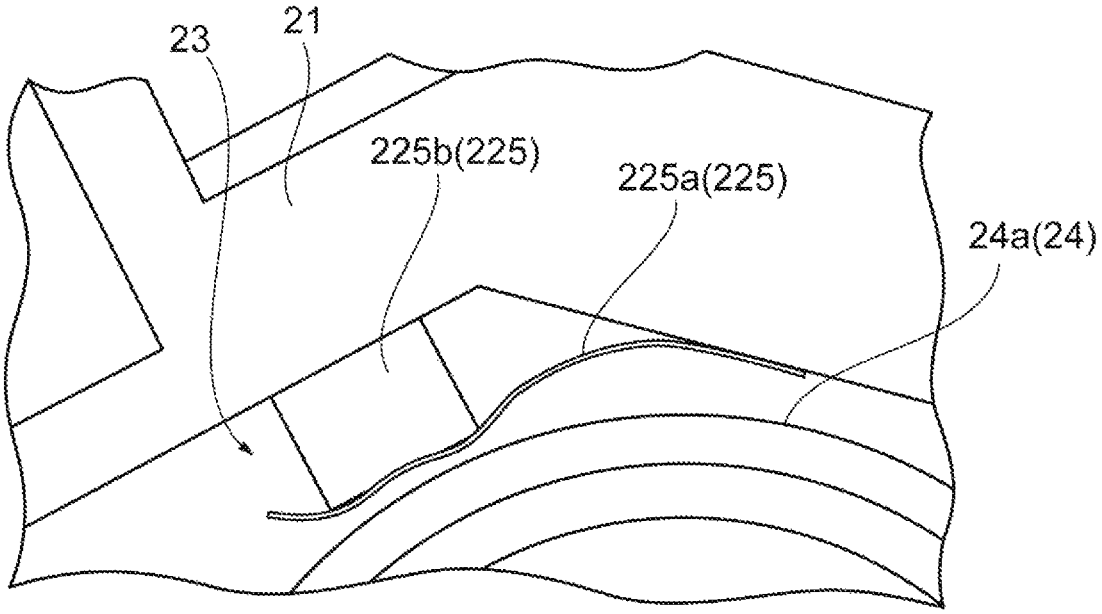
FIG. 6 is a schematic diagram illustrating a portion of a developing device including an example control member.

FIG. 6 is a schematic view of an example control member. As illustrated in FIG. 6, the developing device 20 may include a control member 225 instead of (or in addition to) the configurations described above such as the control member 125, as the example control member that reduces the air flow rate flowing through the conveyance route (or conveyance path) 23. The control member 225 is disposed on the conveyance route 23 to be in proximity to the peeling pole S2 of the developing roller 24. The control member 225 includes an elastic sheet member 225*a* and an elastic member 225*b*. The elastic sheet member 225*a* may include a sheet-like member having elasticity such as a urethane film, as with the elastic sheet member 125*a* described above, and may extend longitudinally along the direction of the axis line 24A of the developing roller 24. One end of the elastic sheet member 225*a* is attached to the housing 21. The elastic member 225*b*, for example, is formed of a member having elasticity such as a sponge, and is attached to the housing 21. The elastic sheet member 225*a* is pressed against the surface of the development sleeve 24*a* of the developing roller 24 by an elastic force of the elastic member 225*b*. The elastic member 225*b* is formed of a member or material having elasticity, to more flexibly accommodate a change in the conveyance amount of the developer.

Figure 7:
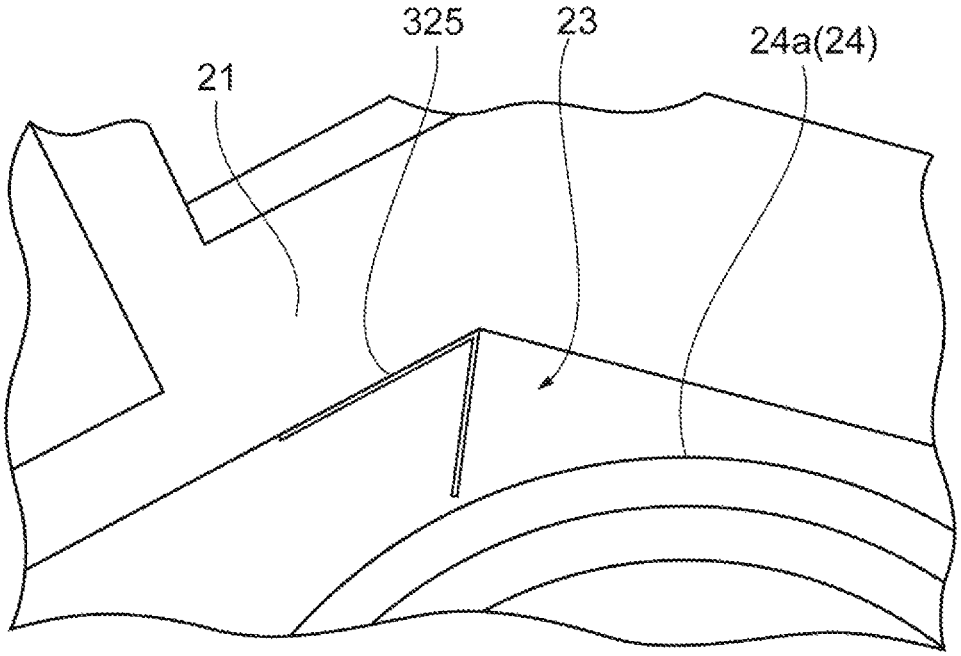
FIG. 7 is a schematic diagram illustrating a portion of a developing device including an example control member.

FIG. 7 is a schematic view of an example control member. As illustrated in FIG. 7, the developing device 20 may include an elastic sheet member 325 instead of (or in addition to) the configurations described above such as the control member 125, as a control member that reduces the rate of air flow flowing through the conveyance route (or conveyance path) 23. The elastic sheet member 325 is disposed on the conveyance route 23 to be in proximity to the peeling pole S2 of the developing roller 24. The elastic sheet member 325 may include a sheet-like member having elasticity such as PET, and may extend longitudinally along the direction of the axis line 24A of the developing roller 24. One end (a first edge) of the elastic sheet member 325 is attached to the housing 21, and the other end (a second edge opposite the first edge) is pressed against the developing roller 24 in a bent state. The elastic sheet member 325 that is bent as described above is flexibly displaced by an elastic force thereof in a case where the conveyance amount of the developer is changed, to more suitably apply a constant pressure to the developing roller 24.

Figure 8:
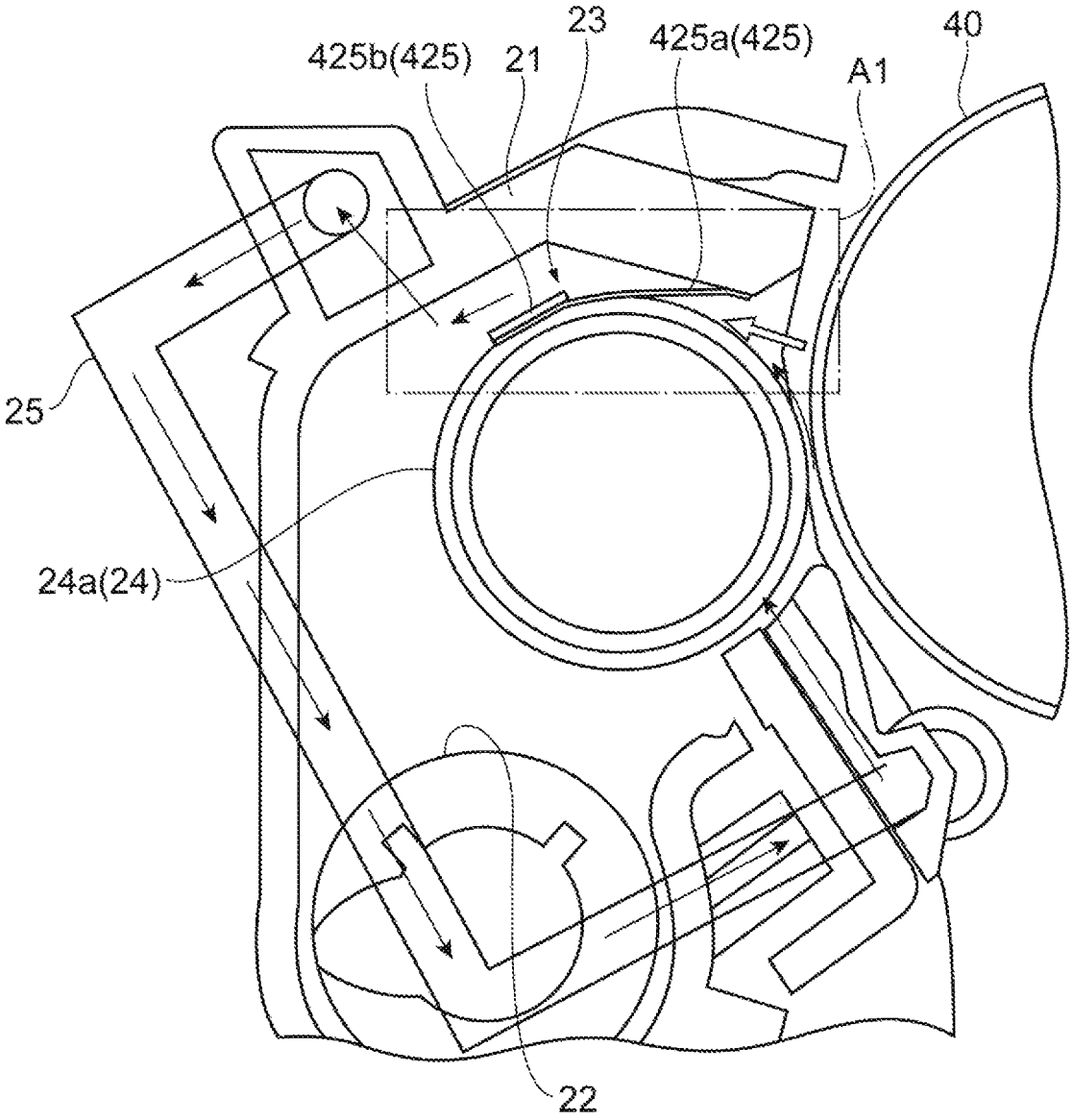
FIG. 8 is a schematic diagram illustrating a portion of a developing device including an example control member.
Figure 9:
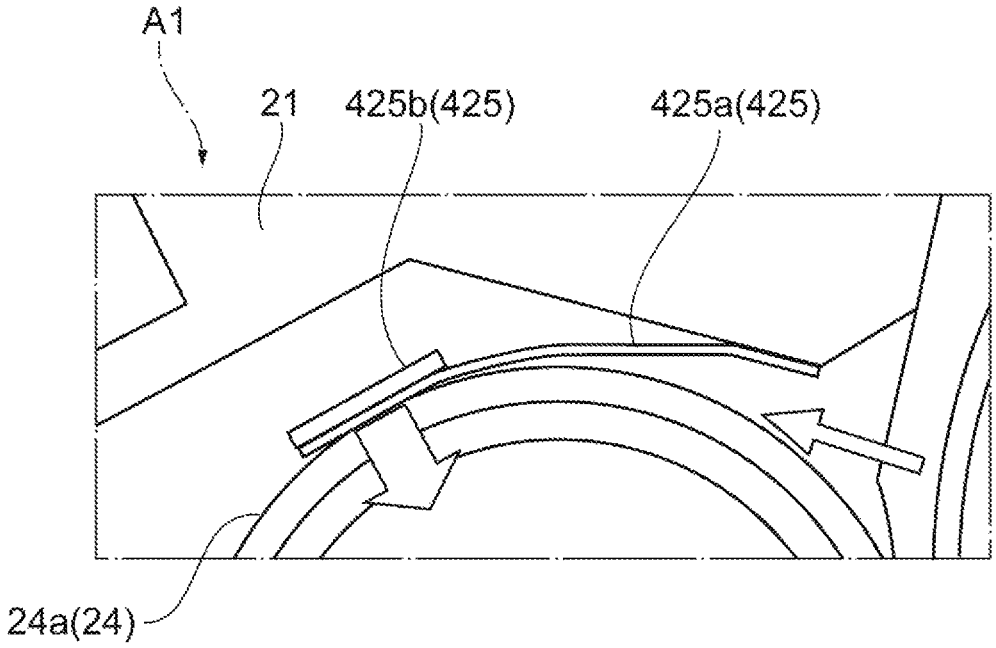
FIG. 9 is an enlarged view of a portion of FIG. 8.

FIG. 8 is a schematic view of an example control member. FIG. 9 is an enlarged view of a portion of FIG. 8 (region A1 in FIG. 8). As illustrated in FIG. 8 and FIG. 9, the developing device 20 may include a control member 425 instead of (or in addition to) the configuration described above such as the control member 125, as the control member that reduces the air flow rate flowing through the conveyance route (or conveyance path) 23. The control member 425 is disposed on the conveyance route 23 to be close to the peeling pole S2 of the developing roller 24. The control member 425 includes an elastic sheet member 425*a* and a magnetic body 425*b*. The elastic sheet member 425*a* may include a sheet-like member having elasticity such as a urethane film, and may extend longitudinally along the direction of the axis line 24A of the developing roller 24. The thickness of the elastic sheet member 425*a* may be equal to or less than 0.2 mm, for example, approximately 0.1 mm. The elastic sheet members 125*a*, 225*a*, and 325 described above may have a similar thickness as that of the elastic sheet member 425*a*. One end (a first edge) of the elastic sheet member 425*a* is attached to the housing 21.

Figure 17A:
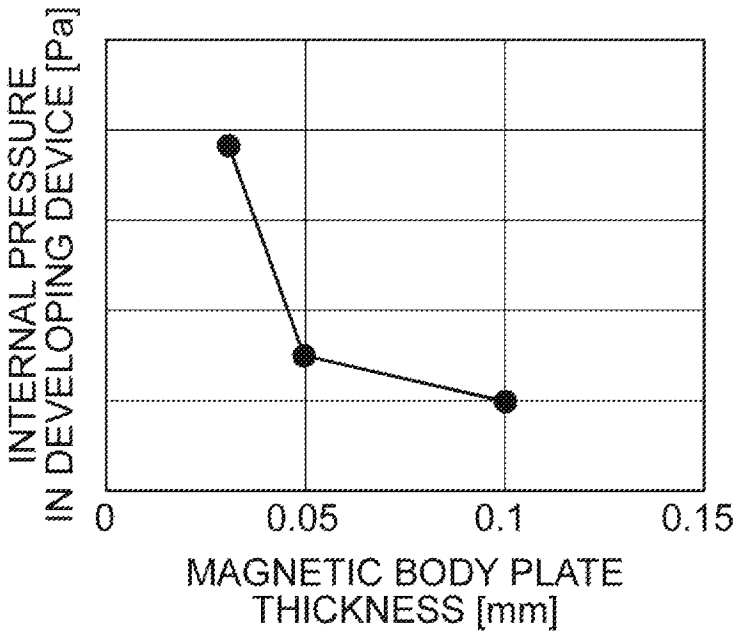
FIG. 17A is a graph of an internal pressure in an example developing device having an example control member.
Figure 17B:
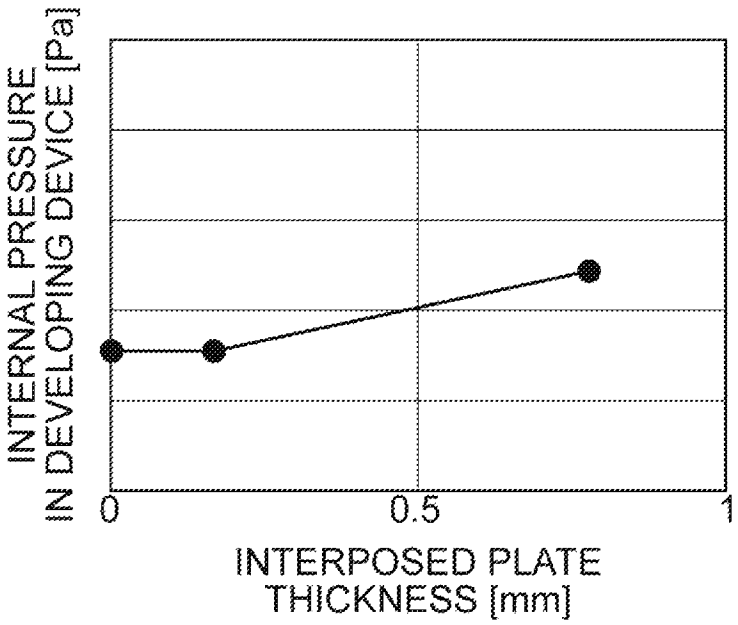
FIG. 17B is a graph of an internal pressure in an example developing device having an example control member.

The magnetic body 425*b* may include a magnetic metal such as Fe, Ni, and Co, and may extend longitudinally along the direction of the axis line 24A of the developing roller 24. The magnetic body 425*b* may be attached to the other end (a second edge opposite the first edge) of the elastic sheet member 425*a* (e.g., an end portion or edge that is not attached to the housing 21). The thickness of the magnetic body 425*b* may be equal to or less than 0.2 mm, for example, approximately 0.1 mm. As shown in FIG. 17A, the air to be taken in is reduced (reducing an internal pressure of the developing device 20) as the thickness increases, until the thickness of the magnetic body 425*b* reaches approximately 0.1 mm. Furthermore, as shown in FIG. 17B, a resin thin plate (for example, ABS) is interposed between the magnetic body 425*b* and the elastic sheet member 425*a*, to increase the internal pressure of the developing device 20 in accordance with the thickness of the thin plate. The magnetic body 425*b* is disposed between the peeling pole S2 and the conveyance pole N1. For example, magnetic body 425*b* may be disposed at a position of 10° to 30° (relative to the rotational axis 24A) toward the conveyance pole N1 from the peeling pole S2. A surface of the magnetic body 425*b* on a side opposite to a surface that is in contact with the elastic sheet member 425*a* may be coated or may include a sheet of a resin or the like, in order to prevent the developer from being attached and to prevent rust. The magnetic body 425*b* may be a magnetic film that is used for suppressing a noise of a smart phone or the like.

In the control member 425, a constant pressure is suitably applied to the developing roller 24 by using a magnetic force of the magnetic body 425*b* that is attracted to the magnet 24*b* of the developing roller 24.

Hereinafter, an effect or operation of the control member to suppress an air intake amount and further activate air circulation as schematically illustrated in FIG. 2 (the circulation represented by an arrow) will be described with reference to FIG. 10 to FIGS. 15A and 15B.

Figure 10:
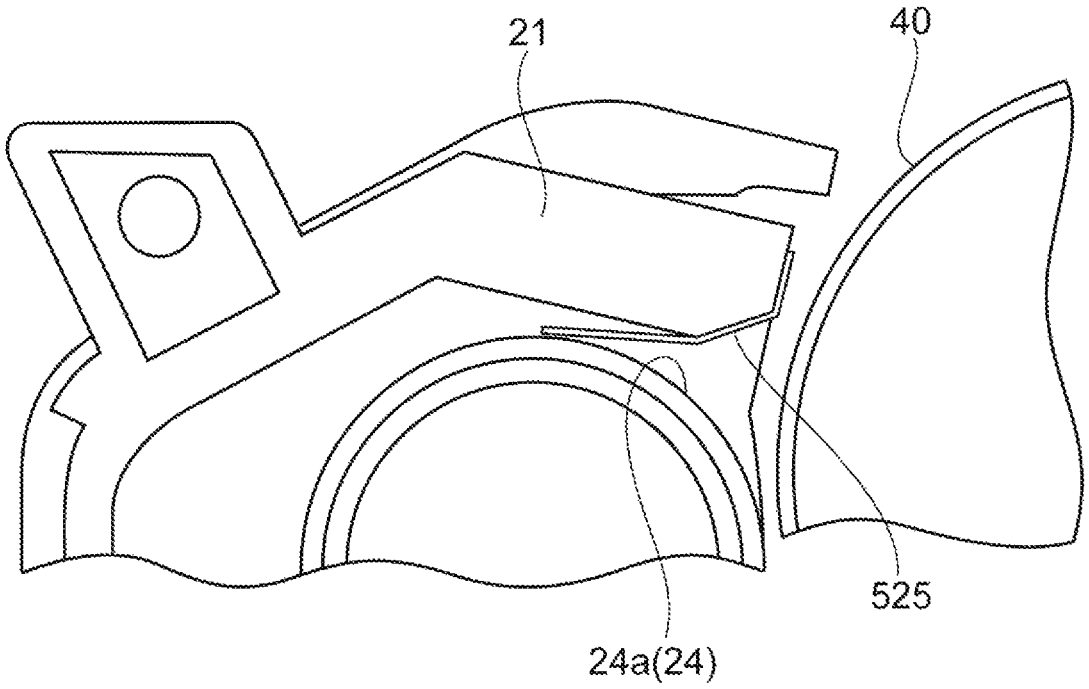
FIG. 10 is a schematic diagram illustrating a portion of a developing device including an example control member.

FIG. 10 is a schematic view of an example control member. As illustrated in FIG. 10, the developing device 20 may include an elastic sheet member 525, as the control member that reduces the air flow rate flowing through the conveyance route (or conveyance path) 23. One end (a first edge) of the elastic sheet member 525 is attached to the housing 21. The elastic sheet member 525 is provided in a region closer to the conveyance pole N1 (cf. FIG. 2), as compared with the elastic sheet member 125*a* or the like, described above, and is attached to a region facing the image carrying body 40 in the housing 21. The elastic sheet member 525 may extend longitudinally along the direction of the axis line 24A of the developing roller 24.

Figure 11:
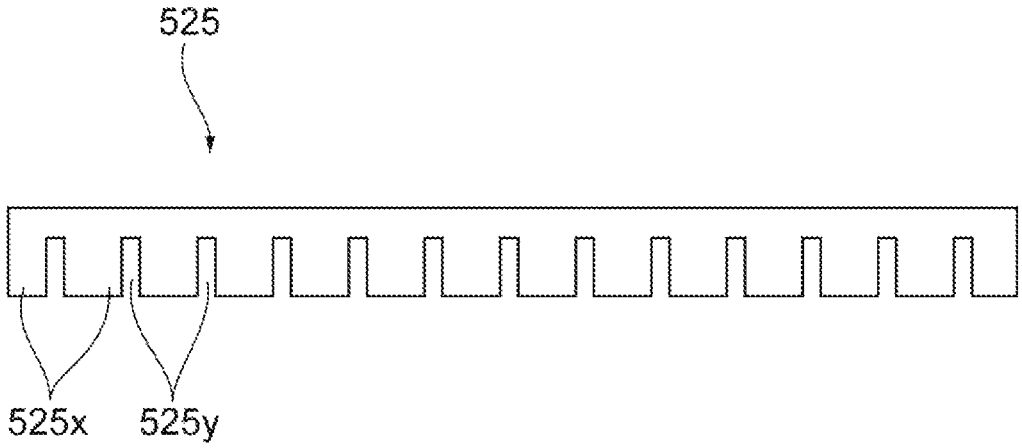
FIG. 11 is a schematic diagram of an example control member.

FIG. 11 is a front view of the elastic sheet member 525 when the elastic sheet member 525 illustrated in FIG. 10 is seen from the image carrying body 40 side. In FIG. 11, a horizontal direction corresponds to the direction of the axis line 24A of the developing roller 24 (e.g. a longitudinal direction of the developing device 20). As illustrated in FIG. 11, the elastic sheet member 525 is comb-shaped and includes cutouts at a regular intervals along a width of the elastic sheet member 525, e.g., in the direction of the axis line 24A of the developing roller 24 (a rotation axis direction or rotational axis direction). Accordingly, the cutouts are spaced apart at substantially equal distances in the longitudinal direction. In some examples, the elastic sheet member 525, includes a comb portion (or closed portion) 525*x* that is an inflow suppressing region where the air substantially does not flow, and a non-comb portion (or cutout portion) 525*y* that is an inflow region in which the air flows. Inflow regions are alternately formed along the longitudinal direction (the direction of the axis line 24A) of the developing roller 24. In the present disclosure, "the air substantially does not flow" refers to cases where the air is completely prevented from flowing and also cases where a negligible or trace amount of air flows. The comb portion (closed portion) 525*x* is a portion in which the air to be taken in (an inflow airstream) is reduced. The non-comb portion (cutout portion) 525*y* is a portion in which the air is circulated (flows through).

An elastic sheet member may suppress the air intake amount, however the elastic sheet member forms a plug and a state of being covered with a lid is obtained such that the air circulation is inhibited, and thus, toner scattering occurs. In the elastic sheet member 525 that is formed into the shape of a comb, the air is suitably circulated by the non-comb portion (cutout portions) 525*y* adjacent to the comb portion (closed portions) 525*x* while reducing the air that is taken in by the comb portion (closed portions) 525*x*, and thus, it is possible to suppress the occurrence of the toner scattering described above. That is, the comb portion (closed portions) 525*x* prevents air circulation, and thus, is weak for the toner scattering, but is capable of suppressing the toner scattering in the comb portion 525*x* by the adjacent non-comb portion 525*y*. In a case where the ratio of the area of the comb portion 525*x* is greater than the ratio of the area of the non-comb portion 525*y*, suppressing capacity described above is not sufficient, and the toner scattering easily occurs. Accordingly the width of the comb portions (closed portions) may be set to be equal to or less than the width of the non-comb portions (cutout portions), to satisfy the following relationship: Width of Comb Portion 525*x*≤Width of Non-Comb Portion 525*y*. In addition, in a case where the width of the comb portion 525*x* increases, the suppressing capacity described above is not sufficient to prevent the toner scattering from easily occurring, and accordingly, the width of the comb portion (closed portions) 525*x* may be, for example, equal to or less than 15 mm.

Figure 12A:
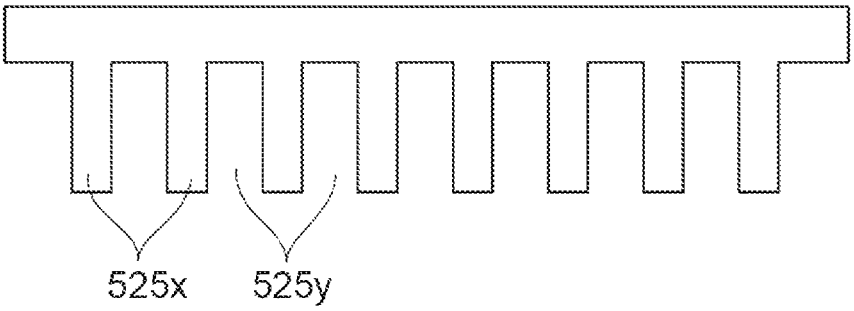
FIG. 12A is a schematic diagram of an example control member.
Figure 12B:
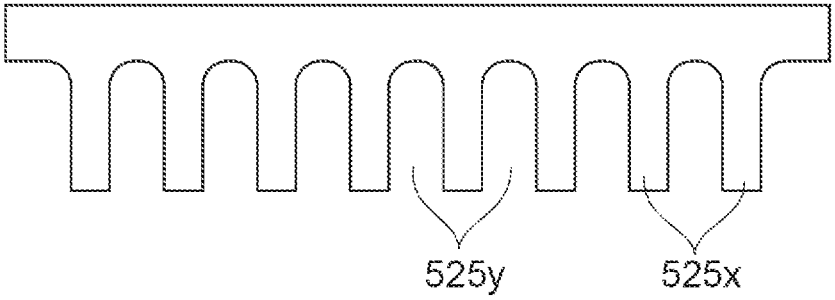
FIG. 12B is a schematic diagram of an example control member.
Figure 12C:
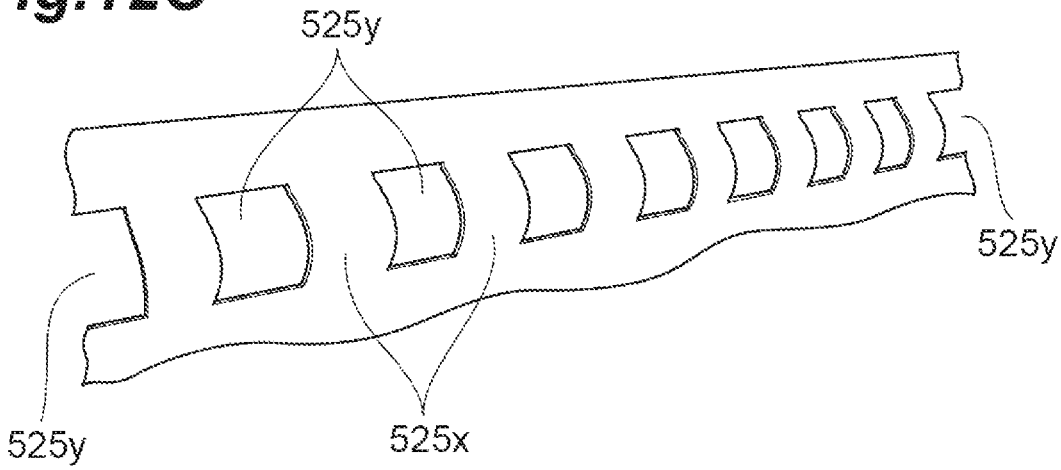
FIG. 12C is a schematic diagram of an example control member.

FIGS. 12A, 12B and 12C illustrate variations of the elastic sheet member 525. In FIGS. 12A and 12B, a horizontal direction is parallel to the direction of the axis line 24A of the developing roller 24. In the example illustrated in FIG. 12A, a root portion (or base) of the comb portion (closed portions) 525*x* in the elastic sheet member 525 is angular in shape (e.g., in the shape of an edge). In the example illustrated in FIG. 12B, the root portion (or base) of the comb portion 525*x* in the elastic sheet member 525 is rounded in shape. The root portion (base) of the comb portion (closed portions) 525*x* is curved, to protect the base (or root portion) of the comb portion 525*x* from breakage. In the example illustrated in FIG. 12C, upper and lower ends of the elastic sheet member 525 are fixed. The elastic sheet member 525 is curved, for example to form an arch. The elastic sheet member may lose elastic properties over time, so as to decrease in inflow airstream reduction capabilities. Accordingly, the elastic sheet member 525 may be curved or arch-shaped to inhibit the decrease in inflow airstream reduction capabilities.

Furthermore, the elastic sheet member 525 may be disposed on the conveyance route (or conveyance path) 23 such that both ends (e.g., longitudinal ends) in the direction of the axis line 24A of the developing roller 24 (the rotation axis direction) form non-comb portions 525*y* corresponding to the inflow region described above. The developing device 20 has a longitudinal end (e.g., an end portion region in the direction of the axis line 24A) that is opened or exposed to the atmosphere, and an inflow force due to the air circulation is less likely to act, however scattered toner contamination may increase when such a longitudinal end is formed as the comb portion 525*x* which is the inflow suppressing region. Instead, the longitudinal end may be formed as the non-comb portion 525*y* to reduce the contamination due to the toner scattering. For example, the non-comb portion 525*y* may include a region of the elastic sheet member 525 that is equal to or greater than 10 mm from a longitudinal end portion in which the developing roller 24 retains or carries the developer.

Figure 13:
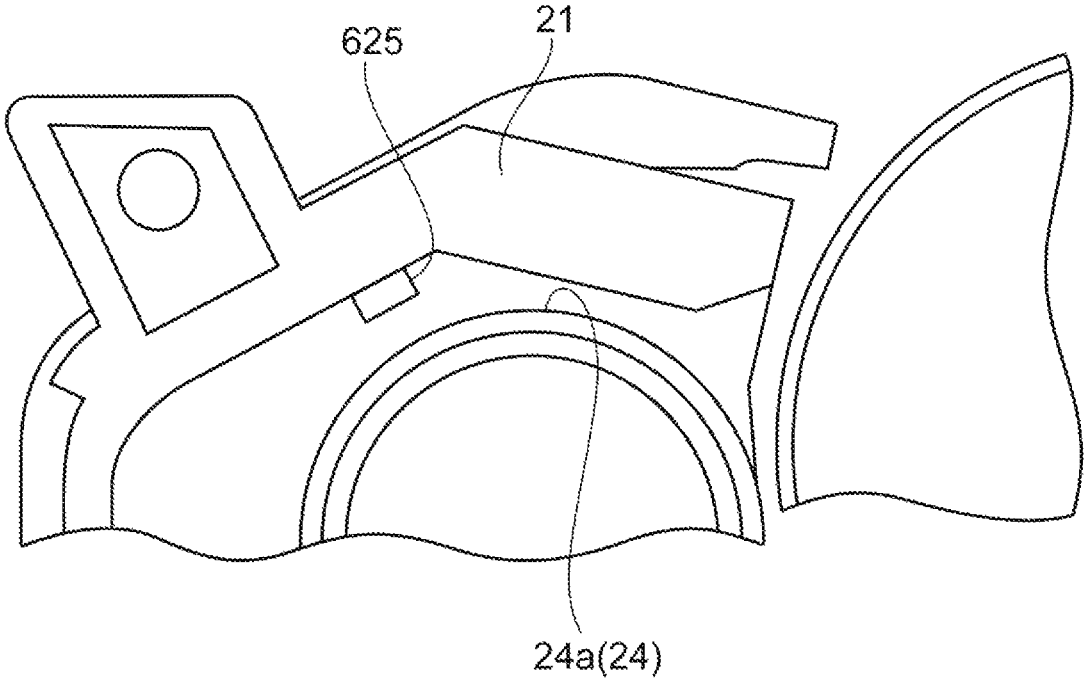
FIG. 13 is a schematic diagram of a portion of a developing device including an example control member.

FIG. 13 is a schematic view of the example control member. As illustrated in FIG. 13, the developing device 20 may include a cover member 625, as the control member that reduces the air flow rate flowing through the conveyance route (or conveyance path) 23. The cover member 625 is disposed on the conveyance route 23 to be close to the peeling pole S2 (cf. FIG. 2) of the developing roller 24, and extends along the direction of the axis line 24A of the developing roller 24, The cover member 625 is attached to the housing 21 and projects toward the developing roller 24. The cover member 625 is disposed on the conveyance route 23 and spaced apart from the developing roller 24 such that a distance from the developing roller 24 (for example, a gap between the surface of the development sleeve 24*a* and a tip end of the cover member 625 that is closest to the development sleeve) is constant in the longitudinal direction of the developing roller 24.

Figure 14:
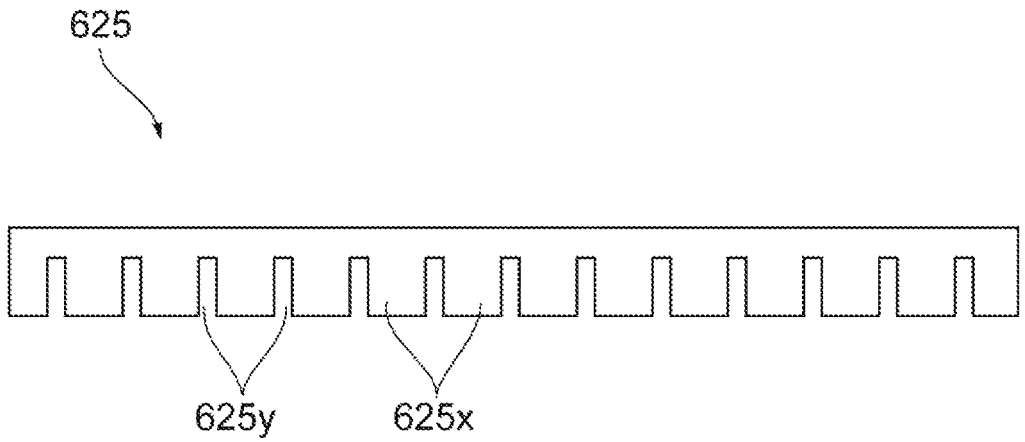
FIG. 14 is a schematic diagram of an example control member.

FIG. 14 is a front view of the cover member 625 illustrated in FIG. 13, when the cover member 625 is viewed from the image carrying body 40 side. Accordingly, in FIG. 14, a horizontal direction is the direction of the axis line 24A of the developing roller 24. A first portion 625*x* of the cover member 625 projecting toward the developing roller 24 by a first protrusion amount, and a second portion 625*y* extending toward the developing roller 24 by a second protrusion amount that is less than the first protrusion amount are formed alternately in the longitudinal direction (e.g., in the direction of the axis line 24A of the developing roller 24 which is the rotation axis direction). Accordingly, the cover member 625 includes a plurality of first portions 625*x* and a plurality of second portions 625*y* forming alternating concave-convex air inflow route. The first portion 625*x* may contact the napping on the developing roller 24 to suppress the air intake amount. The second portion 625*y* provides a passage for the air to flow freely, and circulate the air. The width of the first portion 625*x* (e.g., convex portion) and the width of the second portion 625*y* (e.g., concave portion) may be varied to adjust an internal pressure (an inflow air flow rate).

Figure 15A:
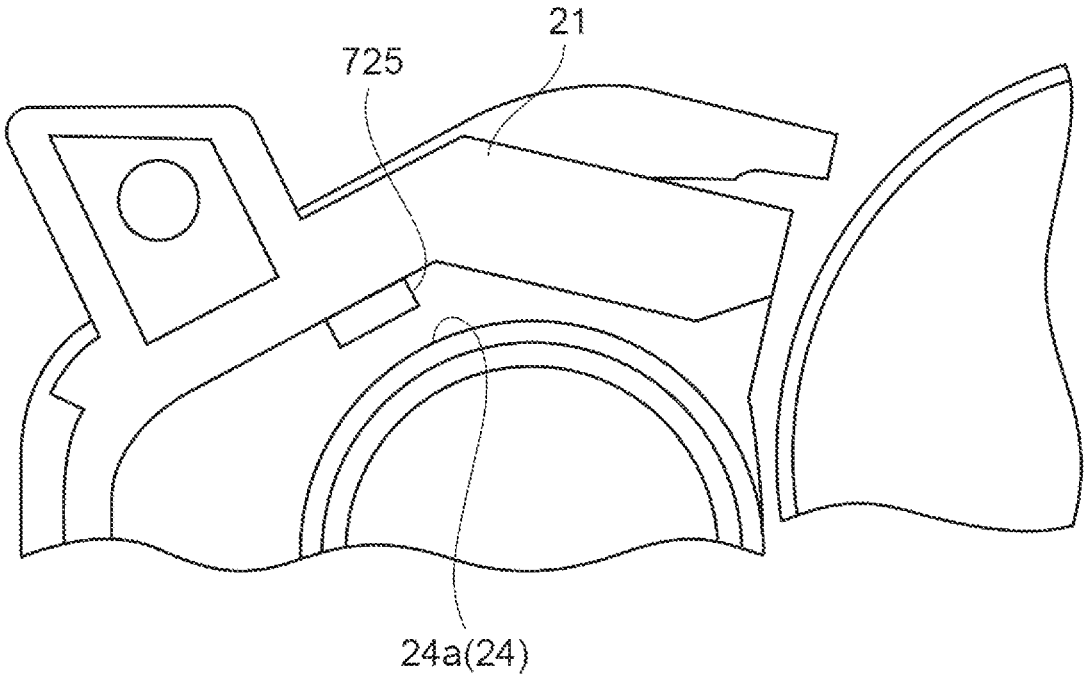
FIG. 15A is a schematic diagram of a portion of a developing device including an example control member and FIG. 15B is a perspective view of a magnetic body to be used in the developing device.
Figure 15B:
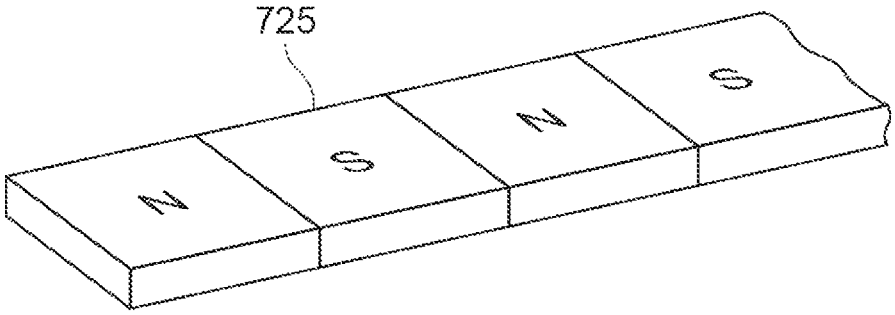

FIG. 15A is a schematic view of an example control member in a developing device 20 and FIG. 15B is a perspective view of a magnetic body to be used in the developing device 20. The developing device 20 may include a magnetic body 725 as the control member to reduce the air flow rate flowing through the conveyance route (or conveyance path) 23. The magnetic body 725 has a first surface that is attached to the housing 21 and that is provided along the longitudinal direction (the direction of the axis line 24A) of the developing roller 24, and a second surface opposite the first surface. Referring to FIG. 15B, the magnetic body 725 is a single-sided multipole magnet in which an N pole and an S pole are alternately magnetized on the second surface of the magnetic body 725. The N pole and the S pole are alternately magnetized in the longitudinal direction of the developing roller 24 (or the direction of the axis line 24A of the developing roller 24 which is the rotation axis direction). In such a magnetic body 725, a hill portion or mountain portion (e.g., a portion in which a large amount of developer is accumulated) and a valley portion (a portion in which the developer is not accumulated) of the developer may be alternately formed along the longitudinal direction of the developing roller 24. The hill portion of the developer that is formed on the magnetic body 725 may contact the napping on the developing roller 24, and suppress the air intake amount. The valley portion that is formed on the magnetic body 725 provides a passage for the air to flow freely, and to circulate the air. As described above, a portion in which the air to be taken in is reduced and a portion in which the air is circulated are formed in the developer, and thus, in a case where a large amount of air flows in, the magnetic body of the magnetic body 725 may be broken, and an air inflow amount can be adjusted to improve a robustness of the developing device 20. In addition, the width of the magnetic body 725 may be varied to adjust the internal pressure (the inflow air flow rate).

An operation of an example developing device 20 in an example image forming apparatus 1 will be described.

The example developing device 20 includes: a housing 21 including a developer containing chamber H; a developing roller 24 to transport the developer that is disposed in the developer containing chamber H and spaced apart from the housing 21 by a distance, the developing roller 24 including a peeling pole S2 located at a fixed position with respect to the housing 21, to discharge or release the developer (e.g., residual developer particles that remain on the developing roller after having been carried through the developing region of the developing roller); a conveyance route (or conveyance path) 23 extending at least partially along the periphery of the developing roller 24 along which flows the air including the developer; and a control member disposed on the conveyance route 23 in proximity to the peeling pole S2 of the developing roller 24, in order to reduce the flow rate of the air flowing through the conveyance route. In some examples, the control member (e.g., 25, 125, 225, 325, 425, 525, 625, 725) is located on a downstream side of the developing region (nip) region in the rotational direction of the developing roller 24. In some examples, the control member is further located on an upstream side of the peeling pole S2 in the rotational direction of the developing roller 24. In some examples, the control member is located closer to the peeling pole than to the nip region. According to some examples, the control member is an auxiliary device that is mounted to the housing in the conveyance route (or conveyance path) 23. According to examples, the control member is shaped to vary the cross-sectional area along the conveyance route 23 such that a first cross-sectional area of the conveyance route 23 taken at the control member is less than a second cross-section area of the conveyance path taken between the developing region (or nip region) and the control member (e.g. taken on an upstream side of the control member in a rotational direction of the developing roller), and the first cross-sectional area is less than a third cross-sectional area of the conveyance route (or path) 23 taken between the control member and the peeling pole S2 (e.g., taken on a downstream side of the control member in the rotational direction of the developing roller). Any one of the first, second and third cross-sectional areas may correspond to a sum of a plurality of cross-sectional areas where the path is divided into a plurality of paths.

Accordingly, the air flow that is taken in the developing device 20 through the conveyance route 23 is suppressed by the control member disposed on the conveyance route 23, to reduce the flow rate of the air, and so as to suppress an increase in the pressure in the developing device 20. When the pressure in the developing device 20 is high, the air including the developer flows out to a developer ejection port formed in the housing, and the developer that is not related to the original control of ADR (e.g., other than the overflow developer) may decrease so as to cause uneven image concentration or erroneous detection by a toner sensor. In addition, when the pressure in the developing device 20 is a high pressure, the air including the developer may also flow out from a portion having weak airtightness, in addition to the developer ejection port, such that the toner scatters, causing in-apparatus contamination. The example developing device 20 suitably suppresses the air flow rate taken in via the control member to suppress or inhibit an increase in pressure in the developing device 20, and thereby, to more effectively inhibit a decrease in the developer due to excessive outflow of the air from the developer ejection port and the toner scattering due to the outflow of the air from a portion having weak airtightness, as described above.

With reference to FIG. 4, the control member may include the cover member 25 that is attached to the housing 21 and that extends or projects toward the developing roller 24. Accordingly, the spaced distance (the gap) between the control member and the developing roller 24 is constant along the longitudinal direction, by way of a simple configuration, to suppress the air to be taken in. In addition, the housing 21 and the cover member 25 may be molded integrally to reduce a molding cost.

The cover member 25 described above is disposed on the conveyance route (or conveyance path) 23 such that the spaced distance (the gap) between the control member (the cover member 25) and the developing roller 24 is constant in the longitudinal direction, in order to achieve a targeted air intake suppression.

The control member may apply a constant pressure to the developing roller 24, to set the air intake amount to be constant even in a case where the conveyance amount of the developer per unit area on the surface of the developing roller 24 is varied.

With reference to FIG. 5, the control member 125 may include the elastic sheet member 125*a* having one end (or a first edge) that is attached to the housing 21, and another end (or a second edge opposite the first edge) to which the weight member 125*b* is attached. The elastic sheet member 125*a* presses the second edge of the elastic sheet member 125*a* against the developing roller 24, to apply a constant pressure to the developing roller 24 by using the weight of the weight member 125*b* (by force of gravity).

With reference to FIG. 6, the elastic member 225*b* may have elasticity to more flexibly adjust to variations in the conveyance amount of the developer, and to more reliably apply a constant pressure to the developing roller 24.

With reference to FIG. 7, the control member may include the elastic sheet member 325 having one end (a first edge) that is attached to the housing 21, and another end (a second edge opposite the first edge) that is pressed against the developing roller 24, so that the elastic sheet member 325 is in a bent state. The elastic sheet member 325 that is bent is pressed against the developing roller 24, and thus, when the conveyance amount of the developer is changed, the elastic sheet member 325 is flexibly displaced, to suitably apply a constant pressure to the developing roller 24.

With reference to FIG. 8 and FIG. 9, the control member 425 may include the elastic sheet member 425*a* having one end (a first edge) that is attached to the housing 21, and another end (a second edge opposite the first edge) to which a magnetic body 425*b* is attached. Accordingly, a constant pressure may be applied to the developing roller 24 by using the magnetic force of the magnetic body 425*b* that is attracted to the developing roller 24.

Figure 16A:
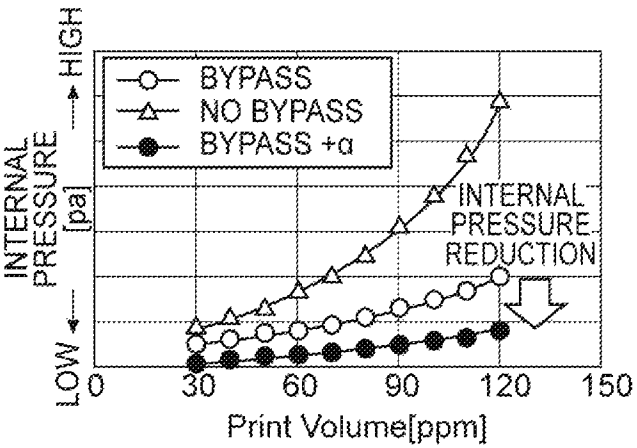
FIG. 16A is a graph of an internal pressure as a function of a print volume in example developing devices.
Figure 16B:
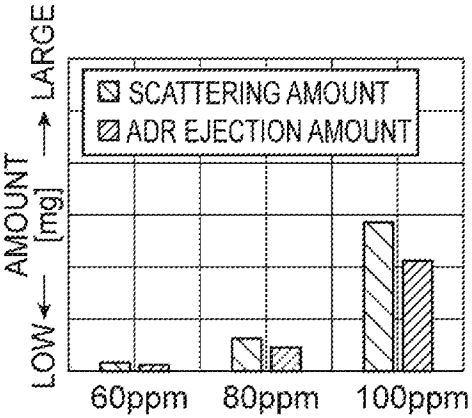
FIG. 16B is a graph indicating a toner scattering amount and an ADR ejection amount at various levels of internal pressures in a comparative developing device without any control member.
Figure 16C:
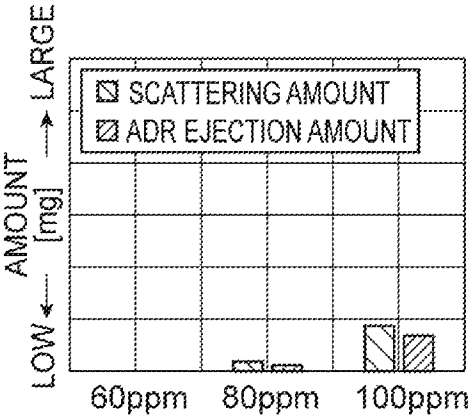
FIG. 16C is a graph indicating a toner scattering amount and an ADR ejection amount at various levels of internal pressure in an example developing device 20 having an example control member.

The graphs of FIGS. 16A, 16B and 16C illustrate example effects of an example developing device 20. With reference to FIG. 16A, for example, it is possible to greatly reduce an internal pressure (for example, to approximately ⅓) by providing the bypass flow path 27, as compared with a developing device without any bypass flow path. In addition, as shown in a graph line identified as "Bypass+α" (which refers to the developing device 20 including the control member 425), the control member 425 in the developing device 20 greatly reduces an internal pressure (further, for example, to approximately ½), as compared to a developing device having a bypass flow path 27 without any control member such as the control member 425.

FIG. 16B shows a toner scattering amount and an ADR ejection amount for various levels of internal pressures in a developing device that is not provided with the control member 425, and FIG. 16C shows a toner scattering amount and an ADR ejection amount for various levels of internal pressure in the developing device 20 that is provided with the control member 425. As shown in FIGS. 16B and 16C, the control member 425 in the developing device 20 greatly reduces the toner scattering amount and the ADR ejection amount. In addition, a sectional area of an ejection route does not increase, so as to reduce the size of the developing device.

With reference to FIG. 10 and FIG. 11, the elastic sheet member 525 may be disposed on the conveyance route (or conveyance path) 23 such that the comb portions 525*x* that are the inflow suppressing regions where the air in prevented or inhibited from flowing, and the non-comb portions 525*y* that are the inflow regions where the air flows are formed alternately in the longitudinal direction of the axis line 24A of the developing roller 24, in order to suppress or inhibit the air intake amount in the inflow suppressing regions, and also more suitably circulate the air by the inflow of the air from the inflow region. The inflow suppressing regions and the inflow regions are alternately formed in the rotation axis direction of the developing roller 24, to circulate the air with an improved balance and evenness in the regions.

As illustrated in FIG. 10 and FIG. 11, the elastic sheet member 525 may include the elastic sheet member 525 of which one end (a first edge or an attached edge) is attached to the housing 21, and the elastic sheet member 525 may be formed into the shape of a comb by forming a cutout at regular space intervals in the longitudinal direction of the axis line 24A of the developing roller 24. The cutout is formed in the elastic sheet member 525 that suppresses the air to be taken in, to suppress or inhibit the air intake and achieve a suitable circulation with a simple configuration.

The elastic sheet member 525 may be disposed on the conveyance route (or conveyance path) 23 such that both longitudinal ends in the direction of the axis line 24A of the developing roller 24 are formed as inflow regions. The end portion region of the developing device 20 is opened to the atmosphere, and thus, a force for circulating the air (for allowing the air to flow in) is less likely to act. Accordingly, in a case where a configuration of suppressing the air to be taken in the end portion region is provided, the air circulation is excessively inhibited, and thus, the toner scattering can be increased. From such a viewpoint, the end portion regions may be formed as the inflow regions described above, to more suitably suppress or reduce the toner scattering.

With reference with FIG. 13 and FIG. 14, the control member may include the cover member 625 that is attached to the housing 21 and extends toward the developing roller 24, and in the cover member 625, the first portion 625*x* extending toward the developing roller 24 by the first protrusion amount, and the second portion 625*y* extending toward the developing roller 24 by the second protrusion amount that is less than the first protrusion amount may be formed alternately in the longitudinal direction (direction of the axis line 24A) of the developing roller 24. In this case, the first portion 625*x* is in contact with the napping on the developing roller 24, so as to suppress or inhibit an air intake and achieve a suitable circulation compatible with a simple configuration.

With reference to FIGS. 15A and 15B, the control member may include the magnetic body 725 that is attached to the housing 21, the magnetic body 725 may be a single-sided multipole magnet, and the N pole and the S pole may be alternately magnetized in the longitudinal direction (the direction of the axis line 24A) of the developing roller 24. Accordingly, hill portions (or mountain portions) and valley portions of the developer are formed in the magnetic body 725, wherein the hill portion contacts the napping on the developing roller 24, so as to suppress or inhibit air intake suppression and provide a suitable circulation compatible with a simple configuration.

The developing device 20 may further include the bypass flow path 27 formed such that the air flowing in the conveyance route (or conveyance path) 23 is taken in, and the air is ejected to the nip region of the developing roller 24. The developing roller 24 rotates, so as to generate a negative pressure on the upstream side of the nip region of the developing roller 24, and to generate a positive pressure on the downstream side of the conveyance route in which the air flows. Accordingly, the bypass flow path 27 that ejects the air flowing in the conveyance route 23 to the nip region is provided, to more suitably suppress or reduce a decrease in a pressure on the downstream side of the conveyance route and an increase in pressure in the developing device 20, so as to better circulate the air.

The invention claimed is:

1. An imaging system comprising:

a housing including a developing chamber;

a developing roller located in the developing chamber to transport developer, the developing roller being spaced apart from the housing, wherein the developing roller includes a peeling pole at a fixed position with respect to the housing to discharge the developer;

a conveyance path extending along at least part of a periphery of the developing roller to form a flow of air including the developer; and a control member located along the conveyance path in proximity to the peeling pole of the developing roller, to reduce a flow rate of the air flowing through the conveyance path, wherein the control member is biased toward the developing roller to apply a constant pressure against the developing roller, and wherein the control member includes a sheet member having a first edge that is attached to the housing, a second edge opposite the first edge, and a weight member attached to the second edge of the sheet member to press the second edge of the sheet member against the developing roller.

2. The imaging system according to claim 1, wherein the weight member has elasticity.

3. The imaging system according to claim 1, wherein the developing roller includes a developing region where the developing roller is closest to an adjacent image carrying body, and wherein the imaging system comprises a bypass flow path extending outside the developing chamber, the bypass flow path having an inlet connected to the developing chamber to receive the air from the conveyance path and an outlet connected to the developing chamber to eject the air toward the developing region of the developing roller.

4. A developing device, comprising:

a housing including a developing chamber;

a developing roller located in the developing chamber to carry a developer in a rotational direction of the developing roller, wherein the developing roller is spaced apart from the housing, wherein the developing roller includes a developing region to transfer the developer to an image carrier, and a peeling pole to which residual developer carried on the developing roller is discharged;

a conveyance path extending between the developing roller and the housing to accommodate an air flow including the developer from the developing region to the peeling pole in the rotational direction of the developing roller; and a control member located in the conveyance path in proximity to the peeling pole of the developing roller to reduce a flow rate of the air flow in the conveyance path, wherein the control member is biased toward the developing roller to apply a constant pressure against the developing roller, and wherein the control member includes a sheet member having a first edge that is attached to the housing, a second edge opposite the first edge, and a magnetic body that is attached to the second edge of the sheet member.

5. A developing device, comprising:

a housing including a developing chamber;

a developing roller located in the developing chamber to carry a developer in a rotational direction of the developing roller, wherein the developing roller is spaced apart from the housing, wherein the developing roller includes a developing region to transfer the developer to an image carrier, and a peeling pole to which residual developer carried on the developing roller is discharged;

a conveyance path extending between the developing roller and the housing to accommodate an air flow including the developer from the developing region to the peeling pole in the rotational direction of the developing roller; and a control member located in the conveyance path in proximity to the peeling pole of the developing roller to reduce a flow rate of the air flow in the conveyance path, wherein the control member extends in a longitudinal direction parallel to a rotational axis of the developing roller, and wherein the control member includes:

inflow suppression regions to inhibit the air from flowing, and;

inflow regions to channel the air to flow therethrough, wherein the inflow suppression regions and the inflow regions are positioned alternately along the longitudinal direction of the control member.

6. The developing device according to claim 5, wherein the control member includes a sheet member forming a comb including:

a first edge extending in the longitudinal direction, that is attached to the housing, and a second edge opposite the first edge, that has cutouts forming the inflow regions, wherein the cutouts are positioned at regular distances along the longitudinal direction of the second edge.

7. The developing device according to claim 5, wherein the control member includes an add-on device that is attached to the housing and projects toward the developing roller, wherein the add-on device includes first portions extending toward the developing roller by a first protrusion distance and second portions extending toward the developing roller by a second protrusion distance that is less than the first protrusion distance, and wherein the first portions form the inflow suppression regions and the second portions form the inflow regions.

8. The developing device according to claim 5, wherein the control member includes a magnetic body that is attached to the housing, and wherein the magnetic body is a single-sided multipole magnet, and includes N poles and S poles that are alternately magnetized along the longitudinal direction of the developing roller to form the inflow suppression regions and the inflow regions.

9. The developing device according to claim 5, wherein the control member has longitudinal ends, wherein each of the longitudinal ends forms one of the inflow regions.

* * * * *